US010279210B2

(12) United States Patent
Ky

(10) Patent No.: US 10,279,210 B2
(45) Date of Patent: May 7, 2019

(54) MAGNETIC FRICTION AND VISCOUS CYLINDER-PISTON RESISTANCE PORTABLE EXERCISE EQUIPMENT

(71) Applicant: Albert Ky, Alameda, CA (US)

(72) Inventor: Albert Ky, Alameda, CA (US)

( * ) Notice: Subject to any disclaimer, the term of this patent is extended or adjusted under 35 U.S.C. 154(b) by 0 days.

(21) Appl. No.: 14/274,630

(22) Filed: May 9, 2014

(65) Prior Publication Data

US 2017/0050069 A1 Feb. 23, 2017

(51) Int. Cl.

| | |
|---|---|
| ***F01L 9/02*** | (2006.01) |
| ***A63B 21/00*** | (2006.01) |
| ***A63B 21/16*** | (2006.01) |
| ***A63B 23/12*** | (2006.01) |
| ***A63B 21/005*** | (2006.01) |
| ***A63B 21/008*** | (2006.01) |

(Continued)

(52) U.S. Cl.

CPC .... *A63B 21/0083* (2013.01); *A63B 21/00192* (2013.01); *A63B 21/015* (2013.01); *A63B 21/151* (2013.01); *A63B 21/153* (2013.01); *A63B 21/157* (2013.01); *A63B 21/16* (2013.01); *A63B 23/12* (2013.01); *F01L 9/02* (2013.01); *A63B 21/005* (2013.01); *A63B 21/00069* (2013.01); *A63B 21/1618* (2013.01); *A63B 23/03508* (2013.01); *A63B 23/03541* (2013.01)

(58) Field of Classification Search

CPC ..... A63B 21/0056; A63B 21/00192; A63B 21/005; A63B 21/0051; A63B 21/0057; A63B 21/15; A63B 21/151; A63B 21/153; A63B 21/154; A63B 21/157; A63B 21/158; A63B 21/16–21/169; A63B 21/008–21/0083; A63B 21/012–21/018; A63B 21/0087; A63B 21/22; A63B 21/00058; A63B 21/00061; A63B 21/00065; A63B 21/00069; A63B 21/00072; A63B 21/00076; A63B 21/00178; A63B 21/00181; A63B 21/00185; A63B 21/00845; A63B 21/0085; A63B 21/015; A63B 21/152; A63B 21/155; A63B 21/156; A63B 21/159; A63B 21/1609; A63B 21/1618; A63B 21/1627; A63B 21/1636; A63B 21/1645; A63B 21/1654; A63B 21/1663; A63B 21/1672; A63B 21/1681; A63B 21/4027; A63B 21/4045; A63B 21/4047; A63B 21/4049; A63B 23/035; A63B 23/03508; A63B 23/03516; A63B 23/03533; A63B 23/03541; A63B 23/12; F01L 9/02

See application file for complete search history.

(56) References Cited

U.S. PATENT DOCUMENTS 5,158,519 A * 10/1992 Hughes ..... A63B 21/157 482/115

5,409,435 A * 4/1995 Daniels ..... A63B 21/00845 482/5

(Continued)

*Primary Examiner* — Gary D Urbiel Goldner

(74) *Attorney, Agent, or Firm* — Patent Alchemy

(57) ABSTRACT

Pairs of magnetic disks and reciprocation piston-cylinders filled with viscous fluid are used to provide friction for a portable exercise apparatus. The viscous fluid in piston-cylinder push-pull configuration provides resistance to an extension cable for physical exercise. The portable exercise apparatus fits in a harness for travel and easy attachment to ordinary household furniture and fixtures.

4 Claims, 11 Drawing Sheets

(51) Int. Cl.
*A63B 21/015* (2006.01)
*A63B 23/035* (2006.01)

(56) References Cited

U.S. PATENT DOCUMENTS 5,816,372 A * 10/1998 Carlson ..... A63B 21/0056 188/155
6,340,080 B1 * 1/2002 Carlson ..... A63B 21/0056 188/267
7,747,355 B2 * 6/2010 Bulthaup ..... H02P 9/06 290/1 C
8,013,457 B2 * 9/2011 Bulthaup ..... H02K 7/1853 290/1 R
8,075,453 B1 * 12/2011 Wilkinson ..... A63B 22/0005 482/51
8,093,731 B2 * 1/2012 Bulthaup ..... H02K 7/1853 206/37.1
8,684,894 B2 * 4/2014 Flynn ..... A63B 21/0004 482/121
9,358,413 B2 * 6/2016 Verdi ..... A63B 71/023
2004/0102292 A1 * 5/2004 Pyles ..... A63B 21/0051 482/54
2005/0124471 A1 * 6/2005 Wilkinson ..... A63B 21/00065 482/121
2009/0017993 A1 * 1/2009 Khanicheh ..... A63B 21/0056 482/49
2009/0036276 A1 * 2/2009 Loach ..... A63B 21/15 482/72
2009/0156362 A1 * 6/2009 Berg ..... A63B 21/0616 482/2
2010/0308149 A1 * 12/2010 Allington ..... A62B 1/08 242/379
2010/0311552 A1 * 12/2010 Sumners ..... A61H 23/0263 482/111
2012/0109025 A1 * 5/2012 Weinberg ..... A63B 23/14 601/5
2015/0367162 A1 * 12/2015 Mueller ..... A63B 21/0058 482/94
2016/0067548 A1 * 3/2016 Shiao ..... A63B 21/4035 482/5
2017/0014661 A1 * 1/2017 Lin ..... A63B 21/018

* cited by examiner

MAGNETIC FRICTION AND VISCOUS CYLINDER-PISTON RESISTANCE PORTABLE EXERCISE EQUIPMENT

BACKGROUND

Field of the Invention

The present invention generally relates to portable exercise equipment and specifically to exercise equipment whose physical weight is much less than the exercise forces that free weights can afford.

The area of physical exercise contains a large diversity of products. In addition, some systems provide feedback to a user of a weight stack machine having a stack of weight plates for lifting one or more of plates from a stack during lifts. Some of these systems use load cells for determining the weight of the weight plates prior to lift and for determining the weight of weight plates remaining on the stack after the user has lifted the plates. These systems may also provide means for evaluating the height of lifted weight plates or the distance that the weight stack is pulled.

One problem which arises from use of weight of a weight stack and the work done on the weight stack. The work done by the user in exerting a force on that weight provides only part of the resistance through which a user applies force and work. The work can also be done without a mass moving, strain work. Work can be done by accelerating the mass, not taken account by a straight weight-height calculation. The work done on a weight machine is not the desired quantity. What is needed is the force and work done by the muscle and on the muscle, which is not the same as the work done on an exercise object or weight stack. In addition, the weight stack machine variety is very heavy and not portable. What is needed are portable light-weight exercise apparatus for the traveler or just the weight lifter that wishes to store the equipment in a small closet.

There exists many body-part centric resistance training equipment such as Arm Curl Machine, Leg Curl Machine, Shoulder Press, Pull down Machine, Leg Extension Machine, Back Extension, Triceps Pushdown, and more. Some can accommodate more than one set of body muscles. But these are all relatively heavy and difficult to port. In addition to the portability is the physical weight cost. An exercise regime using weights for resistance machines are costly and stationary once assembled. Travel, storage space and quick assemble are barriers to regular exercise. What is needed is light, inexpensive and easily portable exercise equipment.

SUMMARY

The present invention discloses a portable tension-resistance exercise equipment with harness to replace much heavier physical weight load equipment. The harness couples an anchor component for wedging in an anchor apparatus conveniently in typical living environments using household furniture or dwelling door jams and alternate static household structures, flexibly attached to a harness having a housing assembly with a freely rotatable gear. An exercise harness with an anchor component for wedging between household furniture and dwelling household structures is flexibly attached to the exercise harness with attached main housing assembly having at least two subassembly friction resistance generation units. The first subassembly contains a magnetic friction unit housed in a cartridge and the second subassembly contains a viscous fluidic cylinder-piston friction unit housed in a separate cartridge with both subassembly units slidably mounted in the main housing assembly and gear mesh coupled to the main gear in the main housing assembly. Each subassembly unit gear is power engaged with the main housing main gear for transmitting resisting tension to power transmitting cable wrapping about the main gear center via a sprocket gear. The wrapping cable attached to the main gear shaft centered rewinding spring and sprocket coupled to the main gear center with both cable ends, entering the main housing structure and wrapping around the main gear center for transmitting power to and from the cable ends. The sprocket free wheel coupled concentrically with the main gear for unidirectional tension transmission and rewinding to its original position after each extension or traction of the power cable about the main gear center. The magnetic subassembly have a rotatable gear affixed to the magnetic subassembly housing, the gear having embedded magnets concentric with an equal number of fixed assembly embedded magnets having magnetic attraction to the concentric fixed non-rotating subassembly magnets in resistance to gear rotation in the magnetic subassembly housing. The magnetic subassembly unit gear with magnetic resistance is meshed with a main gear for power transmission from the cable. The main gear is rigidly affixed to a harness attached shaft common to a rewinding spring with one end affixed to the shaft storing tension with shaft winding. The main gear also has a flexible cable or rope with one end affixed to main gear for turning the gear with load. The cylinder-piston subassembly has a pair of tandem opposing cylinders-piston units alternately pressuring viscous fluid through a channel between the distal ends of the opposing cylinders-piston units. The complementing reciprocating cylinders each have racks coupled to each piston each with a pinion meshed with a half circle toothed pinion, each pinion half gear teeth complementary to the other to coincide with the push-pull piston-cylinder mechanism such that the unit gear upon which the two half gears are rigidly attached to a common shaft whose half gear teeth are 180 degrees out of phase to synchronize with the reciprocating cylinder-piston mechanisms. The cable are rotably attached to the main gear and upon user applied tension provides resistance to exerciser extension, whereby the harness provides resistance force to the turning of the main gear power rope or cable.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

The present invention discloses a portable exercise apparatus. Accordingly, it is an object of the present invention to use light-weight components to create the load resistance equivalent to much heavier and more expensive weight load portable exercise equipment.

Embodiments of the invention are based on two separate types of force resistance integrated into a flexible harness which can be used inside a dwelling taking advantage of a dwelling structure door ways, furniture or exerciser feet as anchor component fix positions, to exercise the different muscle systems in various convenient living locations. The harness is to anchor exercise apparatus conveniently in typical living environments and light weight for portability, yet sturdy and strong enough to handle the typical tension load requirements for indoor and comparable exercise.

Figure 1:
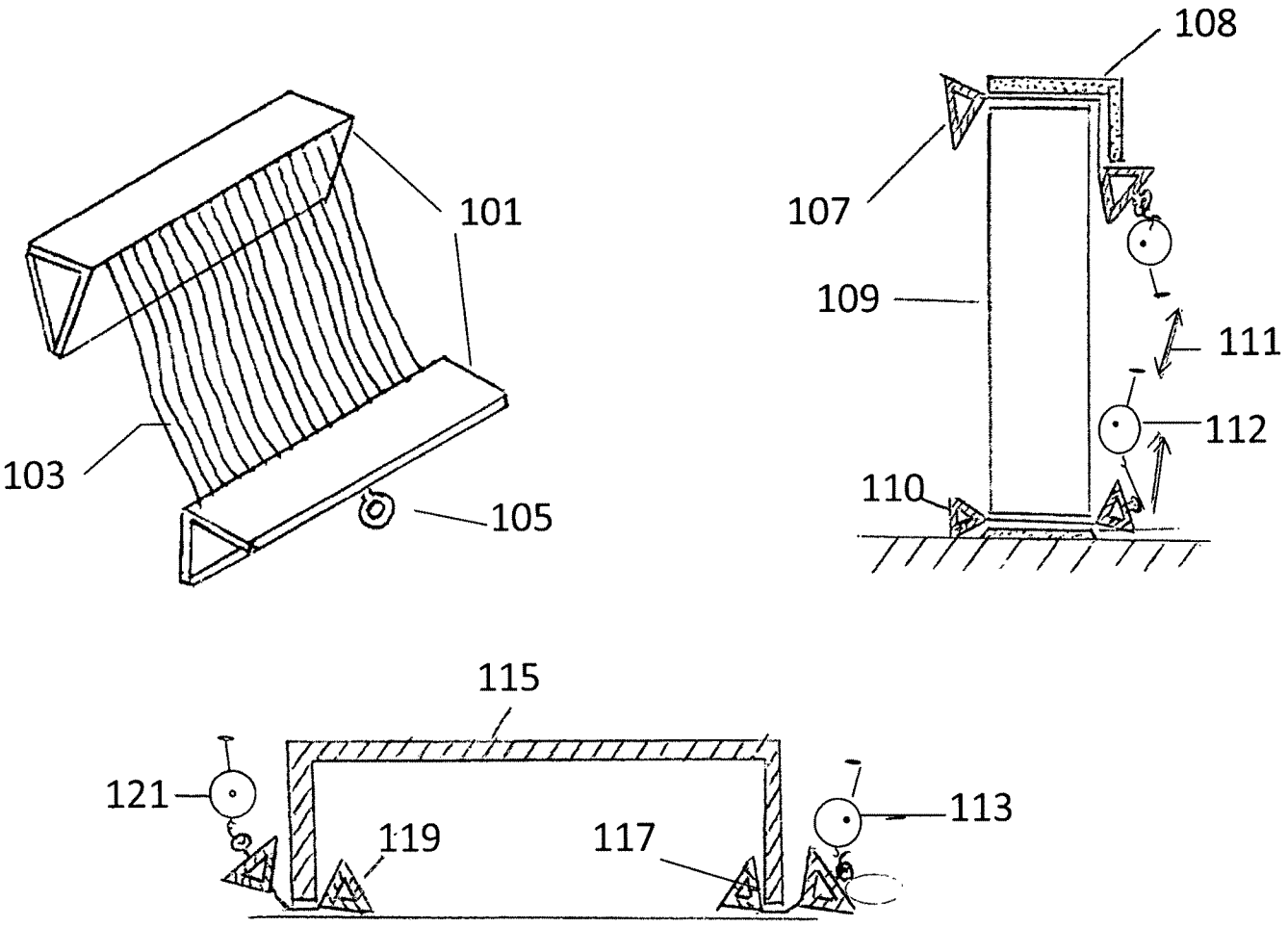
FIG. 1 illustrates the exercise harness anchor components and placement in an embodiment of the present invention.

FIG. 1 illustrates the exercise harness, anchor components and placement in an embodiment of the present invention.

In this embodiment of the invention as Super Portable Weigh, SPW, an apparatus whose harness couplers 112, 113, 105 are coupled to static indoor structures 109, 115 for purposes of resistance type indoor exercise. Locations on a door 109 frame or bed frame 115 are used to wedge anchors 101, 107, 110, 117 and 119. The anchor consists of lite-weight rigid 101, 107, 110, 117, 119 coupled to flexible fiber, rope, ribbon, wire ribbon, plastic or composite tape or cable; a wire ribbon flat fiber 103 is shown. The flat fiber connection can be of any material that is flexible yet able to support a tension of at least 200 lbs. The anchor wedges 101, 107 110 119 117 are positioned relative to the door frame 109 or a bed frame as 115 respectively as shown in FIG. 1 and have a harness coupling. The motion resistance device portion 112 113 121 harness couplers are attached to the wedge anchor 110 117 119 respectively. The harness coupled 105 to the anchor-wedge 101 is designed to be wedged primarily in furniture or household structures for exercising trapazoids, perctoralis, supraspinatus, supraclavicular, deltoid, and other muscle groups.

Figure 11:
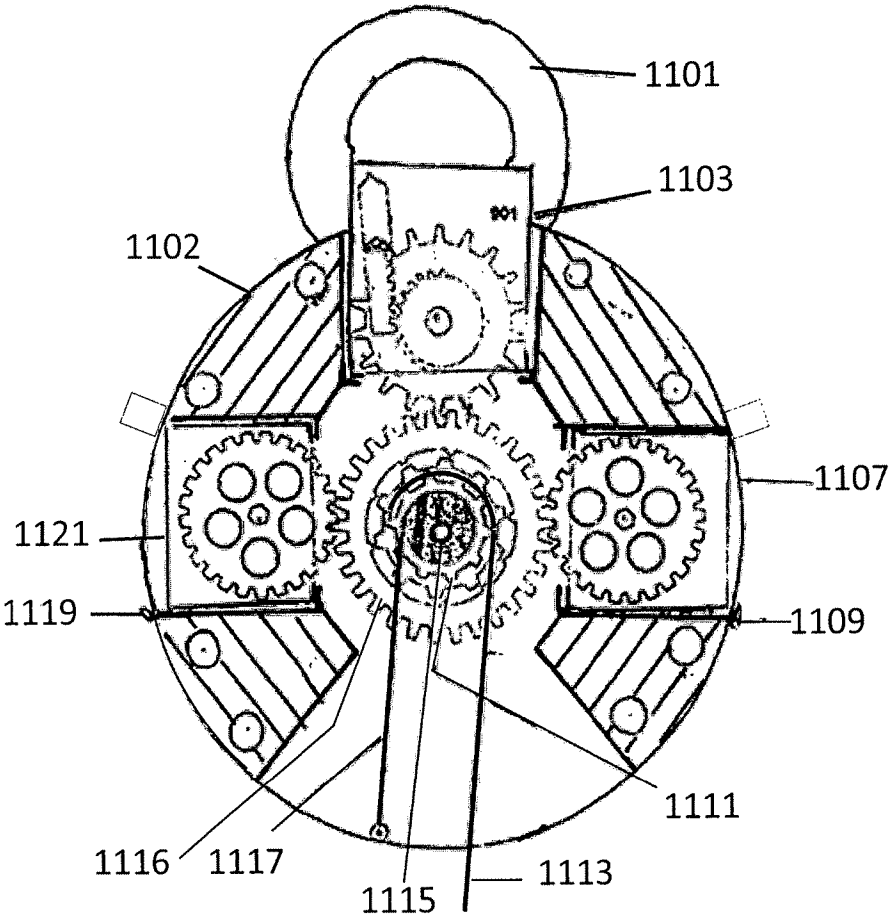
FIG. 11 shows front view of a main housing base assembly with slots occupied with friction mechanism subassemblies in an embodiment of the present invention.

The portable tension-resistance exercise apparatus, SPW, harness coupling 105 with an anchor wedges 101 for wedging between household furniture and alternate dwelling household structures to the anchor component is flexibly attached via the exercise harness coupler 105 to a main housing assembly buckle FIG. 11 1101 with at least 2 subassembly friction resistance generation units.

Figure 2:
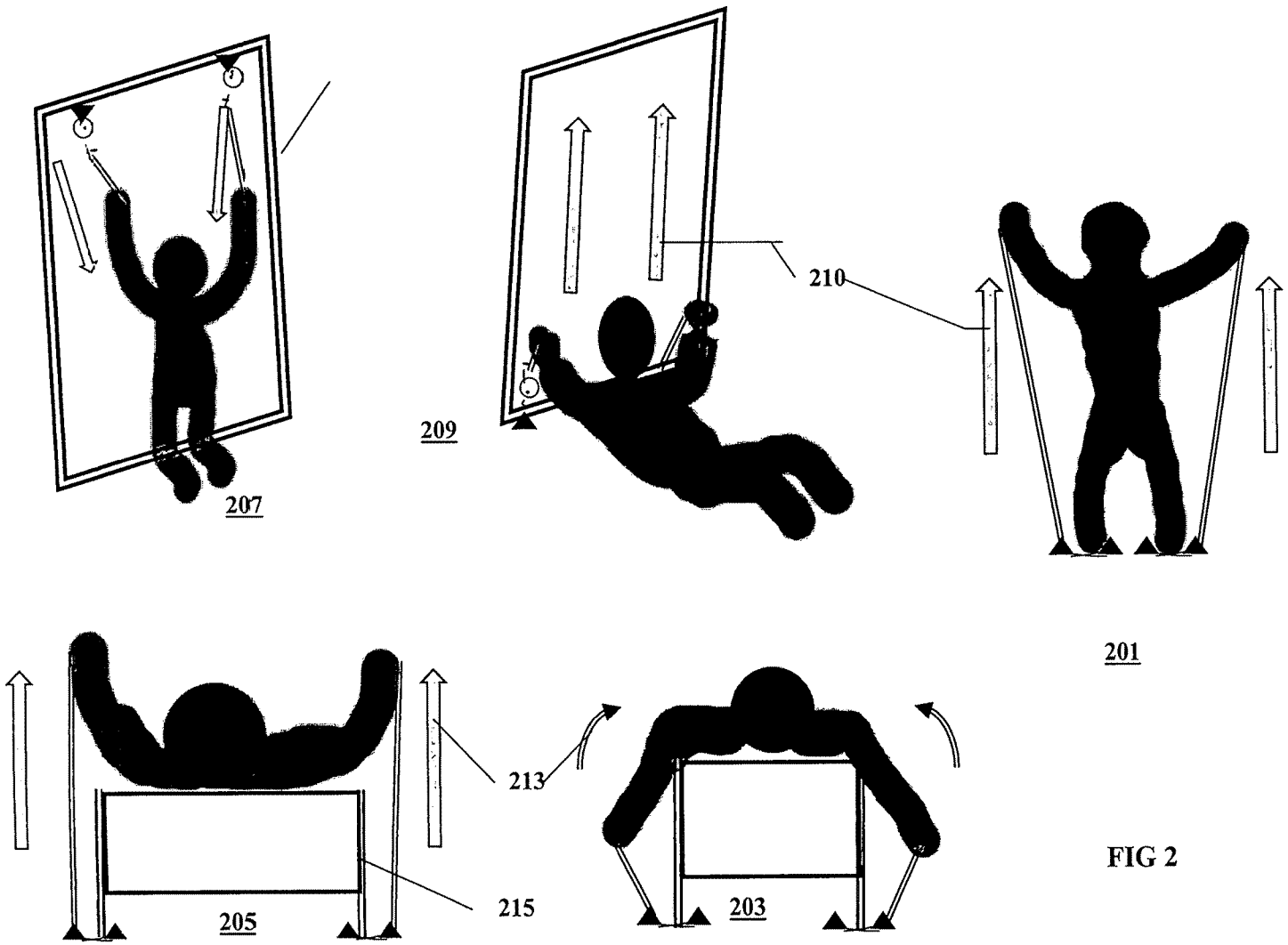
FIG. 2 illustrates the exercise exemplars in application of embodiments of the present invention.

FIG. 2 illustrates the exercise exemplars in application of embodiments of the present invention. The pulling or pushing motions 210 213 made by a user are depicted by the thick arrows. These motions represent exercising the specific muscle groups including the Trapezoids 207, Supraspinatus/Supraclavicular/Pectoralis 209, Deltoid 201, Pectoralis 205, and the Scapula 203. The person figures illustrate some of the modes of exercise which can be done for the benefit of the above muscle groups using embodiments of the invention.

Figure 3:
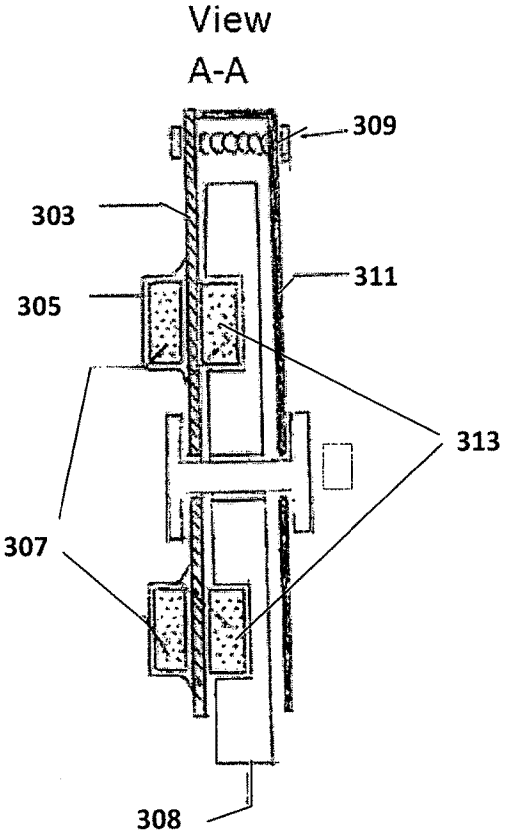
FIG. 3 illustrates a 5 magnet pair embedded in a gear and assembly according to an aspect of the present invention.
Figure 3:
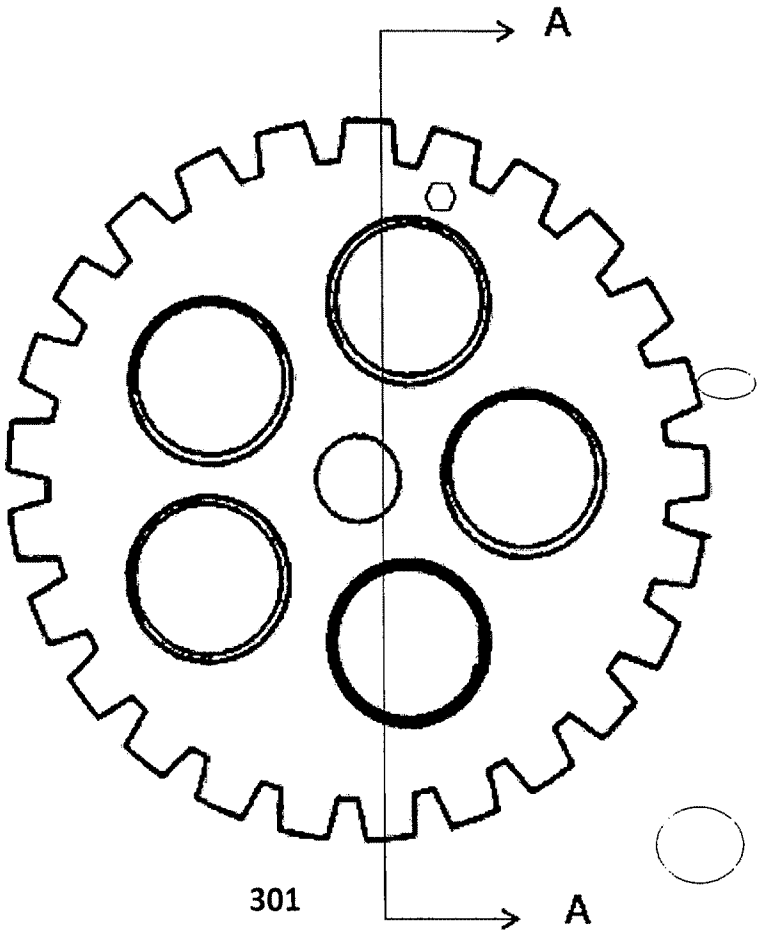

FIG. 3 illustrates a 5 magnet pair embedded in a gear and assembly according to an aspect of the present invention. A magnetic resistance gear 301 is a component in the magnet pair concentrically 307 313 embedded assembly view A-A. The A-A view of the holding plate and gear assembly shows a rigid stationary magnet holder plate 303 with concentric embedded magnets 307 each paired with a concentrically aligned rotating gear 307 rigidly coupled magnets 313. Five such magnet pair placements are depicted 301. The assembly housing is comprised of a flat lite weight but rigid plate casing 311 concentric to and coupled at the gear 307 center. The plate casing is coupled to the holder plate 305 with fasteners 309 on the periphery of the housing 311. When the gear is rotated through the concentric magnet pair field lines are broken and opened causing the initiation and collapse of the coupling magnetic pair field lines producing a resisting mechanical force. The mechanical resistance force is proportional to the magnetic pairs, size, residual magnetism of the materials and components. Many materials and magnetic types can be used. The magnetic force of attraction increases the static and kinetic friction on the gear 313 plate surfaces causing opposing resistance to rotational motion. The magnet pairs are each split, with the gear 301 having one member of each pair 313 and the static plate or holder 303 housing having the other pair member 305 307 on the holder plate 303. The embedded magnet pairs can be of variable size, thickness and shape, but are shown here as flat round and thin in one embodiment.

Figure 4:
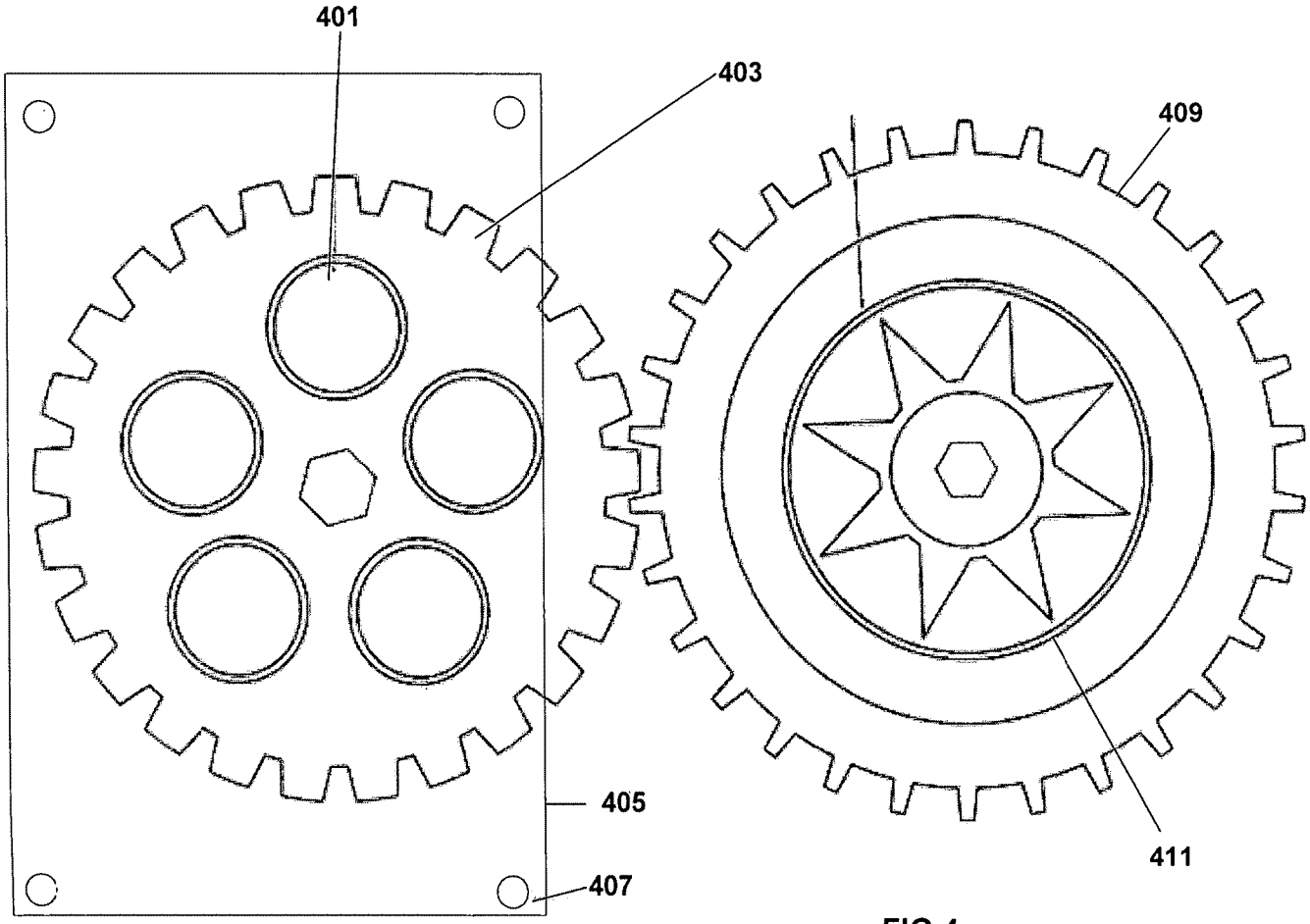
FIG. 4 illustrates a 5 magnet pair gear meshed with a main gear showing an aspect of the present invention.

FIG. 4 illustrates a 5 magnet pair gear meshed with a main gear showing an aspect of the present invention.

The assembly of gear 403, magnets 401 and back housing plate 405 are packaged with a thin flat rigid casing anchored to the plate 405 via fasteners 407, allowing the magnet holding gear 403 to be rotated through magnetic friction about an axis meshed with another gear 409, the main gear 409, through a port cut on one side of this casing 403. The rotational transmission of applied force received through wrapped cable coupled free wheel 411 and is transmitted from the main gear 409 to the meshed magnetic resistant gear 403. The transmission cable and free wheel 411 are coupled to accommodate sudden repeated brief accelerations and intermittent surface seizing from dust. The intermittent friction bursts are smoothed out through alternative friction means. the magnetic subassembly having a rotatable gear 403 rotatably anchored to the magnetic subassembly housing 405, the magnet embedded gear 403 having embedded magnet concentric with an equal number of fixed assembly embedded magnet 401 opposite partners having magnetic attraction to the concentric fixed subassembly magnets in resistance to gear 403 rotation in the magnetic subassembly housing 405. The magnetic subassembly unit gear with magnetic resistance is meshed with a main gear for power transmission from an exerciser pulling cord, rope or cable.

Figure 5:
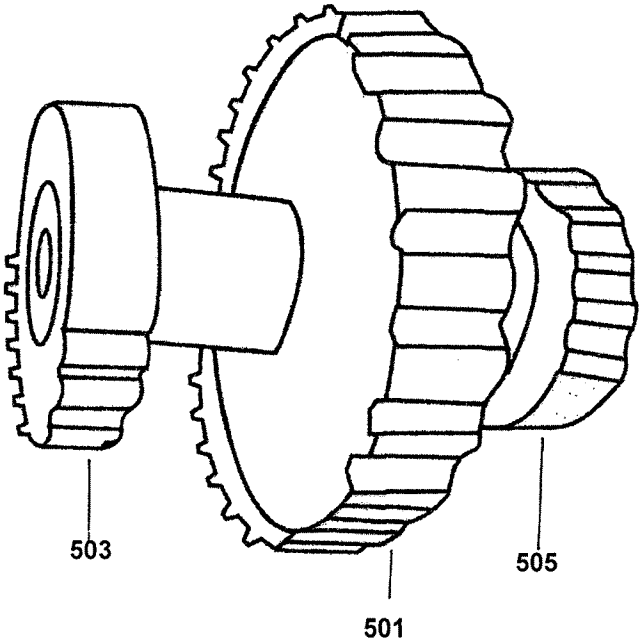
FIG. 5 illustrates complementary half-toothed gears rigidly connected with power transfer gear according to aspects of the present invention.

FIG. 5 illustrates complementary half-toothed gears 503 505 rigidly connected by shaft with power transfer gear 501 according to aspects of the present invention. The half gears 503 505 are concentrically rigidly mounted to the power transfer gear 501 on a rigid coupling shaft, such that power is transmitted from the gear teeth engaging half gears 503 505 in complementary fashion, each half gear 503 505 with gear teeth on half the revolution and mounted 180 degrees opposite the other. This so that only one of the half gears is engaged for transmission for only half the revolution.

Figure 6:
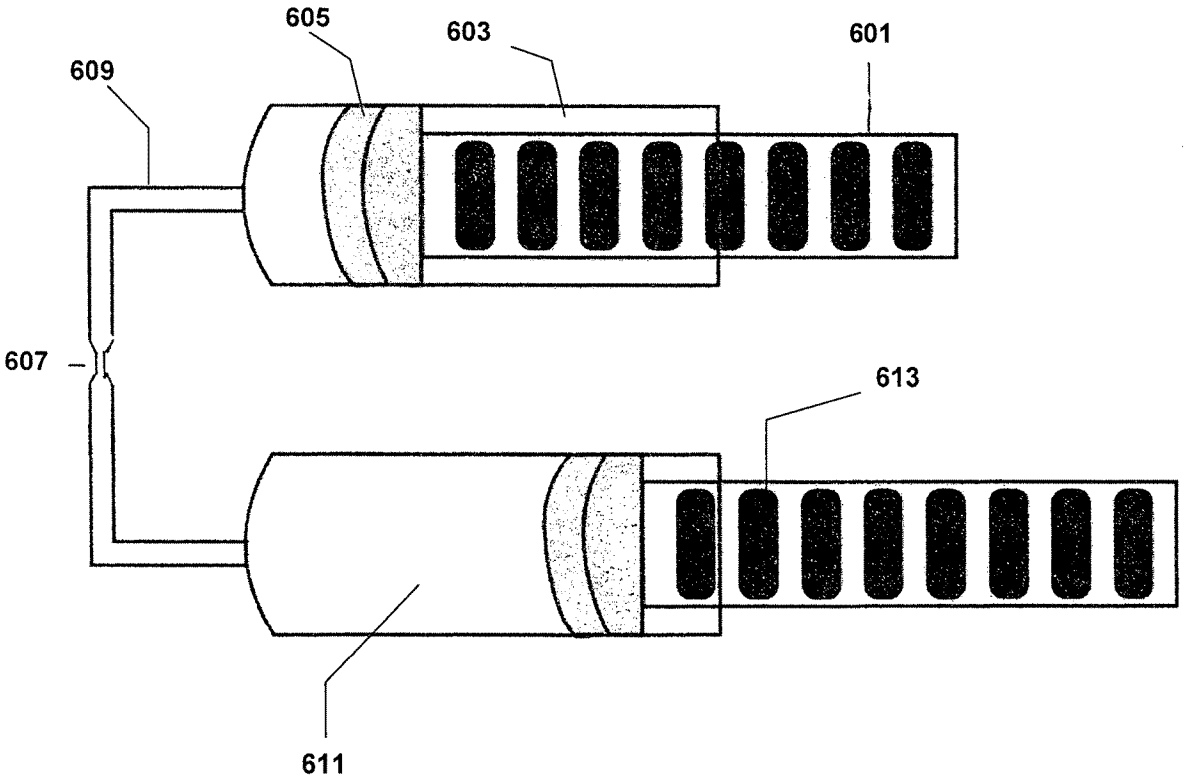
FIG. 6 illustrates complementary pair of rack-in-piston cylinder friction mechanisms according to embodiments of the present invention.

FIG. 6 illustrates complementary pair of rack-in-piston cylinder friction mechanisms according to embodiments of the present invention.

The reciprocating pair of rack-in-piston cylinder 611 603 provide a second type of force resistance to the a meshed gear force transmission. The cylinders 611 contain a viscous fluid that is pushed from one cylinder 611 to the reciprocating cylinder through a conduit 609 with a throttling section 607 for adjusting the viscous fluid resistance through a channel 609 cross section manipulation 607 via a valve or other flow control component. The piston 605 drives the rack-and-pinion 601 gear through the cylinder 603.

Figure 7:
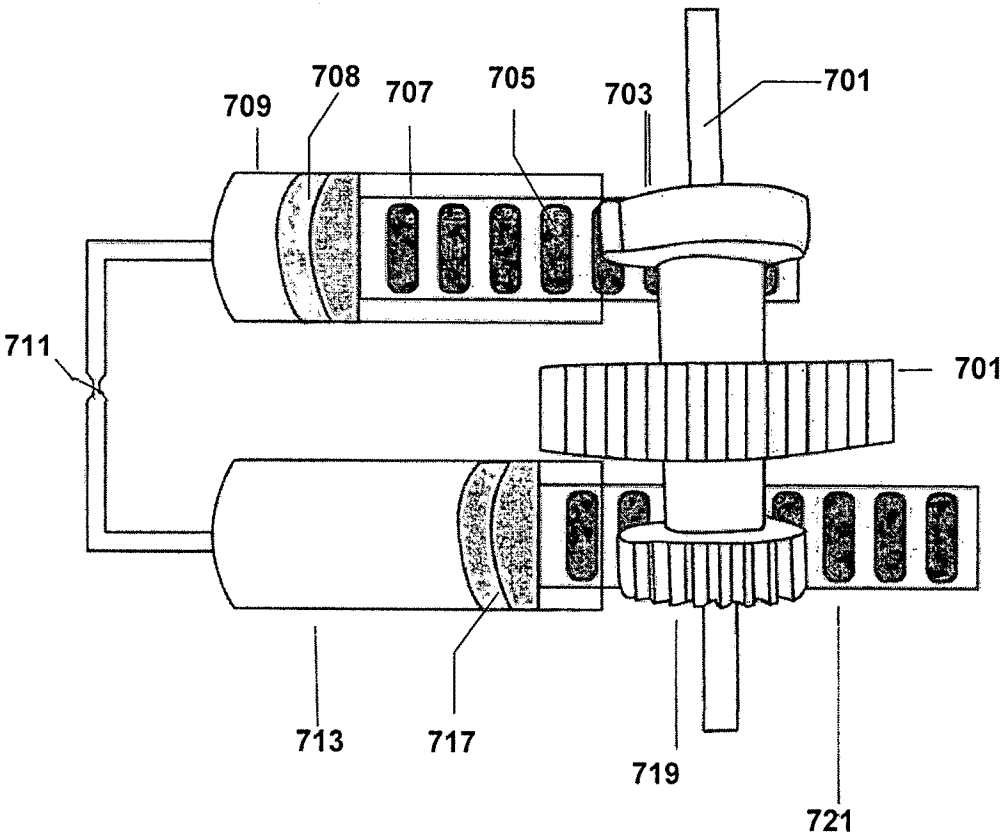
FIG. 7 shows an integration of the complementing 180 degree teeth shifted half-gear components coupled to the synchronizing rack-in-piston-pinion components in an embodiment of the present invention.

FIG. 7 shows an integration of the complementing 180 degree teeth shifted half-gear 703 719 components coupled to the synchronizing rack-in-piston-pinion 705 721 components in an embodiment of the present invention.

The unit gear 701 is rigidly coupled to a shaft 701, between two pinion half gears 703 719 concentrically mounted on a transmission shaft 701. The two pinion half gears 703 719 are positioned with gear teeth covering only half of each gear and with the gear teeth on opposite gears having the gear teeth configured 180 degrees offset from each other, in such a way that when one half gear engages with its rack 705 721, the other disengages with its own rack 705 721. The resulting power transmission alternates from piston A 708 at top of stroke pushing the viscous substance into cylinder B 713 to out stroking the piston B 717 which is not gear teeth engaged to half gear 719, and freely filling the cylinder 713 with viscous fluid without engaging power transmission to the unit gear 701. As the unit gear 701 rotates the half gear 719 engages at the in stroke of the piston 717 driving the piston 717 into the cylinder 713 and pushing the viscous fluid through the connecting channel 711 to the reciprocating cylinder 709. On this cylinder 709 piston 708 outstroke, the opposite half gear 701 drives the half gear on the opposite side. The cylinder-piston subassembly contains a pair of tandem opposing cylinders-piston 713, 717, 709, 709 units alternately pressuring viscous fluid through a channel 711 between the distal ends 709, 713 of the opposing cylinders-piston units; the complementing cylinders 709 713 each with racks 705 721 affixed to each piston 708 717 respectively each meshed with a half circle toothed pinion 703 719, each pinion half gear teeth complementary to the other synchronous with the push-pull piston-cylinder mechanism such that the unit gear 701 upon which the two half gears 701 719 are rigidly attached to a common shaft whose half gear teeth are 180 degrees out of phase.

Figure 8:
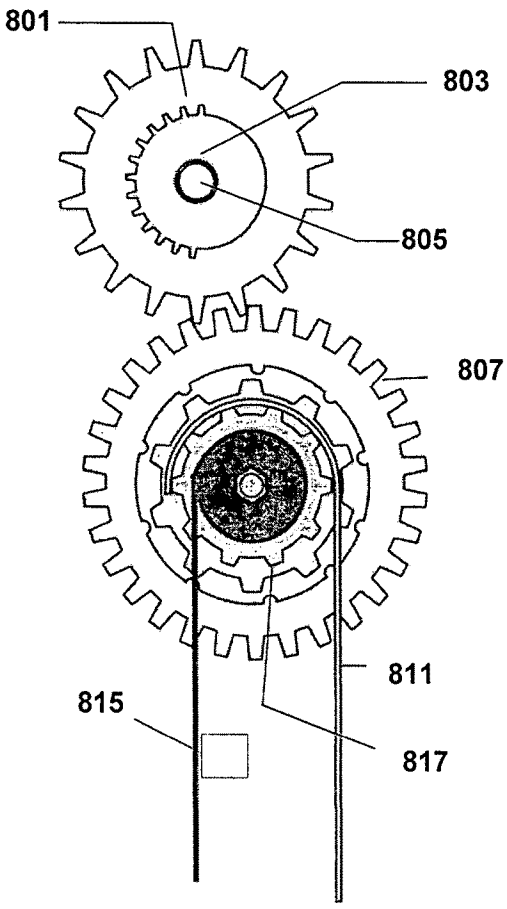
FIG. 8 shows power transmission from the main gear meshed with the unit gear rigidly coupled to complementing opposite half-gears in an aspect of the present invention.

FIG. 8 shows power transmission from the main gear 807 meshed with the unit gear 801 rigidly coupled on a shaft 805 to complementing opposite half-gears 803 in an aspect of the present invention.

The main gear 807 in the assembly transmits power to the unit gear 801 which then transfers the power to its rigidly coupled concentric mounted half-gears 803. The main gear 807 is concentrically coupled to a free wheel 817 coupled to one end of a cable or rope 811 from which the other end is used for human exercise extension and tension. A sprocket free wheel 817 is also coupled to an rewind spring cable 815 which serves to rewind the free wheel 817 and reposition the pulling cable 811 extension end after each extension.

Figure 9:
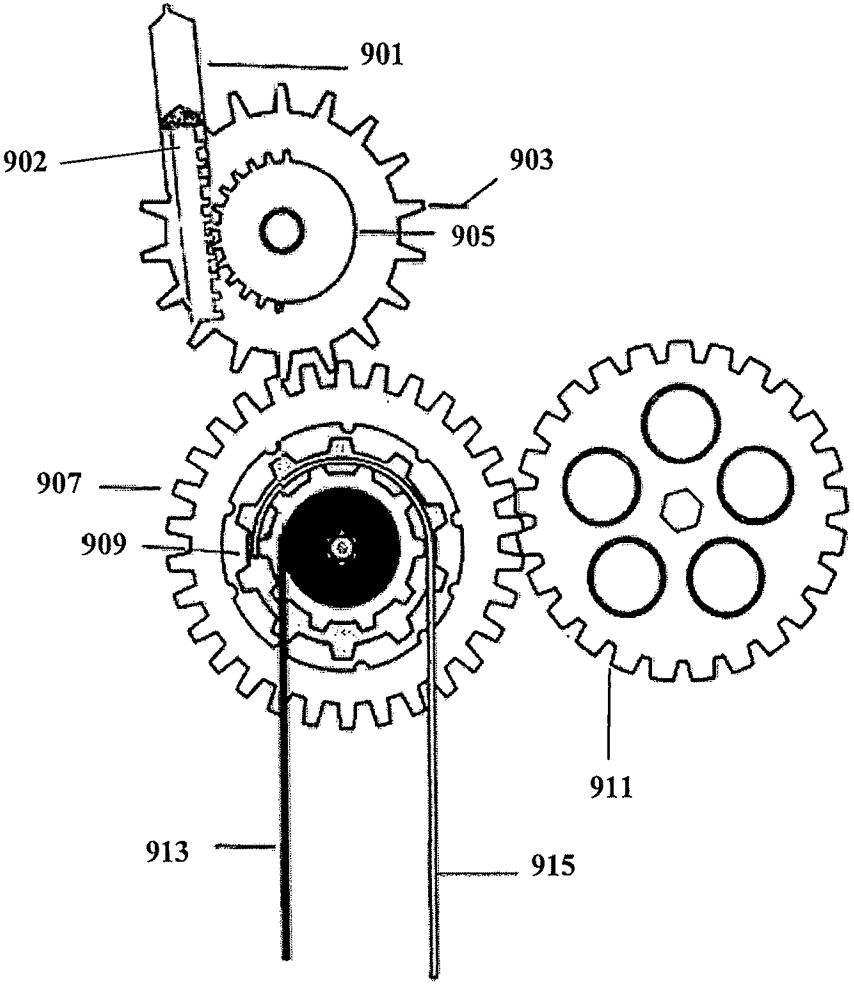
FIG. 9 shows a power transmission gear meshed with a complementary half-teeth gear component meshed with the magnetic friction assembly in an embodiment of the present invention.

FIG. 9 shows a power transmission main gear 907 meshed with a unit gear center shaft coupled to complementary half-teeth gear 905 component meshed with the magnetic friction assembly 911 in an embodiment of the present invention.

The main gear 907 engages the unit gear 903 coupled to the friction enhancing viscous piston-cylinder 901 rack-and-pinion 902 subassembly. The rack-and-pinion 902 assembly is coupled to the complementing half gears 905 such that the engaging half gear teeth are synchronized with the two opposite stroke reciprocating cylinder 901 pistons. The transmitted force originating in the power cable or exerciser pull cord 915 via the sprocket free wheel 909 and into the main gear 907 is attached to the free wheel 909 which is rotated by traction through a wrap around cord 915. A rewinding spring and cord 913 is coupled to the free wheel 909 and functions to rewind the free wheel to its original position after each extension or traction were the rewind spring catch or stick. The sprocket free wheel 909 is coupled concentrically with the main gear 907, for unidirectional tension transmission and to rewind the free wheel 909 to its original position after each extension or contraction of the power cable 915 about the main gear center 907.

Figure 10:
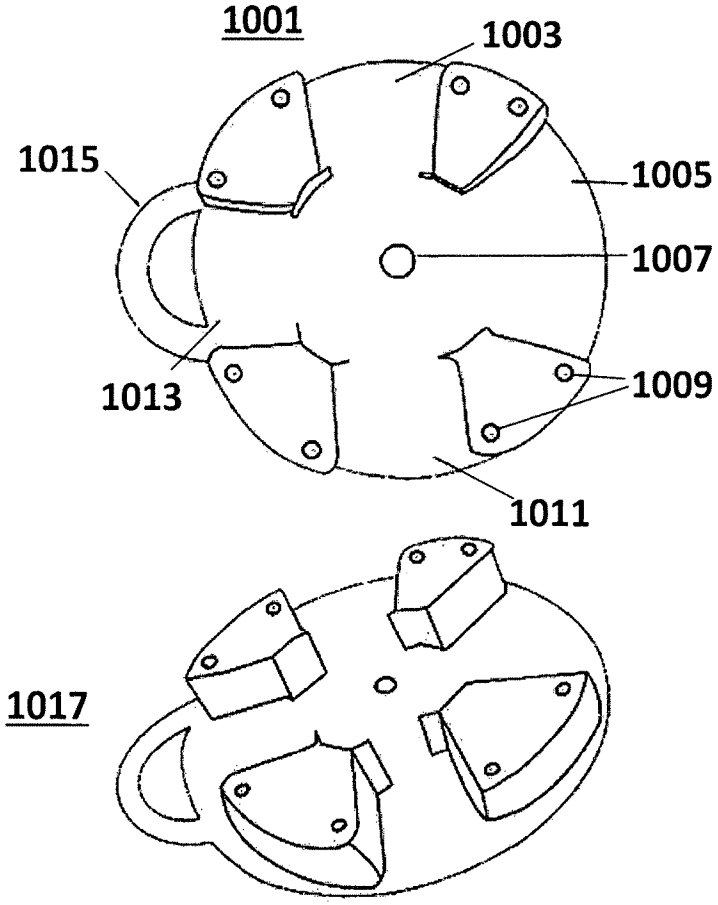
FIG. 10 shows front and isometric views of a main housing base assembly with open slots for mechanism subassemblies in an embodiment of the present invention.

FIG. 10 shows front 1001 and isometric view 1017 of a main housing base assembly with open slots for mechanism subassemblies in an embodiment of the present invention.

The Main housing base assembly 1001 is comprised of rigid materials such as metal, hard plastic or composites. A center hole 1007 for coupling the main gear anchors the main gear to the main housing base 1001. Slots for the magnetic 1003 1011 and Cylinder-Piston 1013 subassembly cartridges are radial situated with respect to the main gear axial 1007 center. Fasteners 1009 secure the slot walls to the base 1001 which provide for slide placement of the magnetic and Cylinder-Piston half gear subassemblies. A suspension buckle 1015 is rigidly attached to the base to support the tensions and forces for the manual exercises to a ready indoor anchor point.

FIG. 11 shows front view of a main housing base assembly with slots occupied with friction mechanism subassemblies in an embodiment of the present invention.

A port 1107 for a magnetic gear cartridge subassembly 1121 containing a magnetic friction unit housed in a cartridge in a port 1107 for a second subassembly containing the viscous fluidic cylinder-piston friction unit 1103 housed in a separate cartridge, both subassembly units slidably fixed to the main housing assembly 1102 and gear meshed to the main gear 1116 in the main housing assembly 1102. Each subassembly unit gears 1121 1103 are power meshed with the main housing gear 1116 for transmitting resisting tension force to power transmitting cable 1113 wrapping about the main gear center 1115.

The second subassembly containing the viscous fluidic friction cartridge unit 1103 provides a smoothing function on the main housing unit and specifically on the first subassembly magnetic friction cartridge 1121 unit. Magnetic unit design can vary and some designs for the first assembly can produce intermittent surface seizing or friction bursts between the magnetic pair surface contact. The viscous fluid subassembly cartridge 1103 adds a dampening effect to the mechanism to smooth out any jerking motion from the magnetic subassembly cartridge 1121.

A suspension buckle 1101 is hinge coupled to the main assembly housing base 1102. The base slots are shown occupied with cylinder-piston 1103 cartridge and two magnetic cartridges 1103 1121. These have locking mechanisms 1105 1109 1119 1123 to for slidably installing and removing the cartridges 1103 1121 into their base slots. A slot opposite the suspension buckle 1101 is maintained for the extensor cord 1113 and sprocket rewind spring on the main gear. The main gear is coupled to the base through the base center hole 1115.

The wrapping cable or exerciser pulling rope 1113 is power coupled to the main gear shaft 1115 centered free wheel rewinding spring 1117 and coupled to a main gear center 1115 shaft with both cable ends 1117 1113 entering the main housing structure 1102 and wrapping around the main gear center 1115 for transmitting power to and from using the cable 1117. The main gear 1116 is coupled to the main housing 1102 shaft 1115 and user exercise tension is harnessed by coupling the tension to a free wheel sprocket rewinding spring with one end coupled to the shaft for transmitting tension to shaft winding. The main gear 1116 is coupled to the free wheel via a common shaft center, and the flexible puller component, cable or rope having one end coupled to main gear 1116 for turning the gear with load for transmission of load to the subassemblies 1121 1103 1107. The rope or cable 1113 sprocket winding is rotably coupled to the main gear 1116 upon which exerciser pulling on the cable will engage with the resistance gear subassemblies 1121 1103 1107 to provide resistance to puller tension. The exercise harness is coupled to the suspension buckle 1101 to anchor the exercise harness to provide resistance force to the turning of the main gear power rope or cable.

An embodiment of the invention is to provide a modularity to the SPW component of the exercise harness. The main housing provides slots for magnetic friction cartridges or viscous fluid cylinder-rack cartridges. These are all packed and packaged in strong durable rigid material with a small opening in the housing for the extension cable. The packaging can be of such materials as plastic, metal, composite, wood and combinations. A prototype composed of:

| | | |
|---|---|---|
| 1 magnetic resistor cartridge weighs | 8 OZ | provides 128 OZ resistance force |
| 1 magnetic resistor cartridge weighs | 8 OZ | provides 128 OZ resistance force |
| 1 magnetic resistor cartridge weighs | 8 OZ | provides 128 OZ resistance force |
| 1 viscosity resistor cartridge weighs | 9 OZ | provides 114 OZ resistance force |
| The free wheel, the main gear, the box weigh | 16 OZ | |
| The total weight | 49 OZ | provides 488 OZ resistance force |

This proves out an object of the invention to provide exerciser extension resistance force that is roughly 10 times the weight of the device.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A portable tension-resistance exercise apparatus with an exercise harness to anchor the portable tension-resistance exercise apparatus conveniently to static household structures, the portable tension-resistance exercise apparatus comprising:

the exercise harness coupled to an anchor-wedge, the anchor-wedge lodged between the static household structures;

the anchor-wedge flexibly attached to the exercise harness, the exercise harness is coupled to a main housing assembly with at least two subassembly friction resistance generation units;

at least one of the at least two subassembly friction resistance generation units containing a magnetic friction unit housed in a cartridge of a magnetic gear cartridge subassembly, and at least one of the at least two subassembly friction resistance generation units containing a pair of tandem reciprocating viscous fluidic cylinder-piston friction units housed together in a separate cartridge of a viscous fluid gear cartridge subassembly, the at least two subassembly friction resistance generation units being slidably mounted in the main housing assembly and gear coupled to a main gear in the main housing assembly;

the at least two subassembly friction resistance generation units are power-engaged with the main gear for transmitting resisting tension to a power transmitting cable wrapping about a main gear center of the main gear via a sprocket gear;

the power transmitting cable attached to a main gear shaft with a centered rewinding spring and the sprocket gear coupled to the main gear center with cable ends of the power transmitting cable entering the main housing assembly and wrapping around the main gear center for transmitting power to and from the cable ends;

the sprocket gear coupled concentrically with the main gear for unidirectional tension transmission and rewinding of the sprocket gear after extension or contraction of the power transmitting cable about the main gear center;

the magnetic friction unit comprising a magnetic friction unit rotatable gear affixed to the cartridge of the magnetic gear cartridge subassembly, the magnetic friction unit rotatable gear having a first set of embedded magnets, the magnetic friction unit further comprising a rigid stationary holder plate having a second set of embedded magnets, the first set of embedded magnets respectively being concentric with, spaced apart from, paired with, and magnetically attracted to the second set of embedded magnets, thereby providing resistance to rotation of the magnetic friction unit rotatable gear in the magnetic gear cartridge subassembly;

the magnetic friction unit rotatable gear coupled to the main gear for power transmission via the power transmitting cable;

the main housing assembly coupled to the exercise harness;

the pair of tandem reciprocating viscous fluidic cylinder-piston units synchronized for alternately pressuring viscous fluid through a channel between distal ends of each of the pair of tandem reciprocating viscous fluidic cylinder-piston units;

the pair of tandem reciprocating viscous fluidic cylinder-piston units respectively having two racks, each rack having one rack end coupled to a piston and another rack end, opposite the one rack end, operatively coupled to a half circle toothed pinion, each half circle toothed pinion having a half gear complementary to the respective rack, wherein the two half circle toothed pinions are rigidly coupled to a common shaft and the two half gears are 180 degrees out of phase such that when one half gear engages with its respective rack, the other half gear disengages with its respective rack, wherein a viscous fluid gear cartridge subassembly gear is rigidly coupled to the common shaft between the two half circle toothed pinions, and wherein the viscous fluid gear cartridge subassembly gear is coupled to the main gear;

the power transmitting cable provides resistance to exerciser extension when tensioned, whereby the exercise harness provides resistance force to turning of the main gear and the power transmitting cable.

2. The portable tension-resistance exercise apparatus of claim 1, wherein the first and second sets of embedded magnets each respectively comprise at least five flat magnets.

3. The portable tension-resistance exercise apparatus of claim 1, wherein the anchor-wedge is flexibly attached to the exercise harness with a rope, flat tape or cable.

4. The portable tension-resistance exercise apparatus of claim 1, wherein the anchor-wedge is lodged between the static household structures for exercising trapezius, pectoral, supraspinatus, supraclavicular, deltoid, and other muscle groups.

* * * * *